United States Patent [19]

Manning

[11] 4,450,425

[45] May 22, 1984

[54] APPARATUS FOR REMOTE CLOSING OF FUSE CIRCUITS

[76] Inventor: Donald R. Manning, Susquehanna Ave., Milton, Pa. 17847

[21] Appl. No.: 208,258

[22] Filed: Nov. 19, 1980

[51] Int. Cl.[3] ..... H01H 71/10

[52] U.S. Cl. ..... 337/171; 337/168

[58] Field of Search ..... 337/168, 169, 170, 171, 337/172, 173, 174, 175, 176, 177, 178, 179, 180, 181, 207, 208, 209, 210, 211, 156, 143, 155, 157; 200/146

[56] References Cited

U.S. PATENT DOCUMENTS 2,011,449 8/1935 Kerr ..... 337/169

3,810,060 5/1974 Hubbard ..... 337/171

*Primary Examiner*—Harold Broome

*Attorney, Agent, or Firm*—Z. T. Wobensmith, III

[57] ABSTRACT

Apparatus for remote closing of fuse circuits for overhead power lines is described which apparatus comprises a rod of insulating material for insertion into the bottom of a fuse tube, the rod having a cord attached thereto and extending to the ground for swinging the fuse tube so that the fuse tube can be moved to a position for closing a disconnect, thereby rendering it unnecessary to close a transformer or tip switch from the pole or from a bucket truck. The rod has an enlarged cushioned head and can be removed by releasing the tension on the pulling cord, and the rod will slide out of the fuse tube and fall to the ground.

8 Claims, 8 Drawing Figures

APPARATUS FOR REMOTE CLOSING OF FUSE CIRCUITS

BACKGROUND OF THE INVENTION

1. Field of the Invention

This invention relates to apparatus for remote closing of a disconnect for overhead power lines.

2. Description of the Prior Art

Switch devices now available for connecting electrical apparatus to an overhead power line have resulted in serious injuries to linemen using such devices.

Mannen, in U.S. Pat. No. 2,936,193, shows a switch stick for manipulation and installation of fuses on overhead power lines which includes a shaft 10 described as of a length of about fifteen feet about two inches in diameter, intended for installing a fuse weighing approximately thirty eight pounds. The switch stick includes a rope operated carrier slidable along the stick for releasably supporting a fuse member, the stick having means at its upper end to engage a fuse mounting.

The Mannen structure is cumbersome and not easy to manipulate to remove or replace a fuse and is limited to the length of the shaft. The metal parts which are included also can involve electrical hazards.

Hubbard, in U.S. Pat. No. 3,810,060 shows a remote closing power load pickup device for moving a conductive switch member 14 to circuit closing position by pulling on a lanyard or cord 76 which is permanently attached to a lever arm 70, the lever arm 70 being attached by rivets 87 to the contact section 50 which carries the conductive switch member 14.

One serious objection to the Hubbard structure is that it is necessary to initially climb a pole to install the device and then climb the pole a second time to remove the lanyard.

It has also been proposed as shown in *Electrical World,* May 1, 1980, published by McGraw-Hill P.O. Box 430, Hightstown, N.J. 08520 at page 57 and 58, to employ a fuse holder of the type shown in the Mannen patent, and which fuse holder can be hooked into notched arms carried by an insulated support, and to mount a clamp intermediate the ends of the fuse holder. The attachment takes from five to fifteen minutes to install. The clamp has an arm extending therefrom with a cord attached to the arm to swing the fuse holder to closed position. Thereafter by inserting a switching tool or stick, with or without a pig tail attachment, into an opening in a release lever and elevating the clamp. It is intended to snap free from the fuse holder.

A serious objection to the structure just described is that it is necessary to climb the pole to place the fuse holder into its notches, and then to climb the pole again to manipulate the hot line tool or stick for removal of the clamp from the fuse holder.

The apparatus of the present invention is simple and easy to use, is safe, and avoids the necessity for a second climb.

SUMMARY OF THE INVENTION

In accordance with the invention apparatus is provided for remote closing of fuse circuits and in which a pivotally carried fuse tube, supported from an overhead power line has a rod of insulating material inserted therein, the rod having a cord attached thereto for swinging the fuse tube to an upward position to close a disconnect, the rod having an enlarged cushioned head and being removable by releasing the tension on the pulling cord so that the rod will slide out of the fuse tube and fall to the ground pulling the rod from the ground.

It is the principal object of the invention to provide apparatus for swinging a fuse tube to an upright position by a rod inserted therein and actuated by pulling a cord attached to the rod, the cord also aiding in removal of the rod from the fuse tube after completion of the movement of the fuse tube.

It is a further object of the invention to provide apparatus for swinging a fuse tube to a connecting position which has a high order of safety and which will reduce the climbing required by the lineman with presently available apparatus.

It is a further object of the invention to provide apparatus for use with a pivotally carried fuse tube which is simple and inexpensive in construction, and is reliable for safe operation.

It is a further object of the invention to provide apparatus for the purposes referred to which can be readily retrieved in a simple manner.

It is a further object of the invention to provide apparatus of the character aforesaid which upon removal will not be hazardous to the user.

Other objects and advantageous features will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
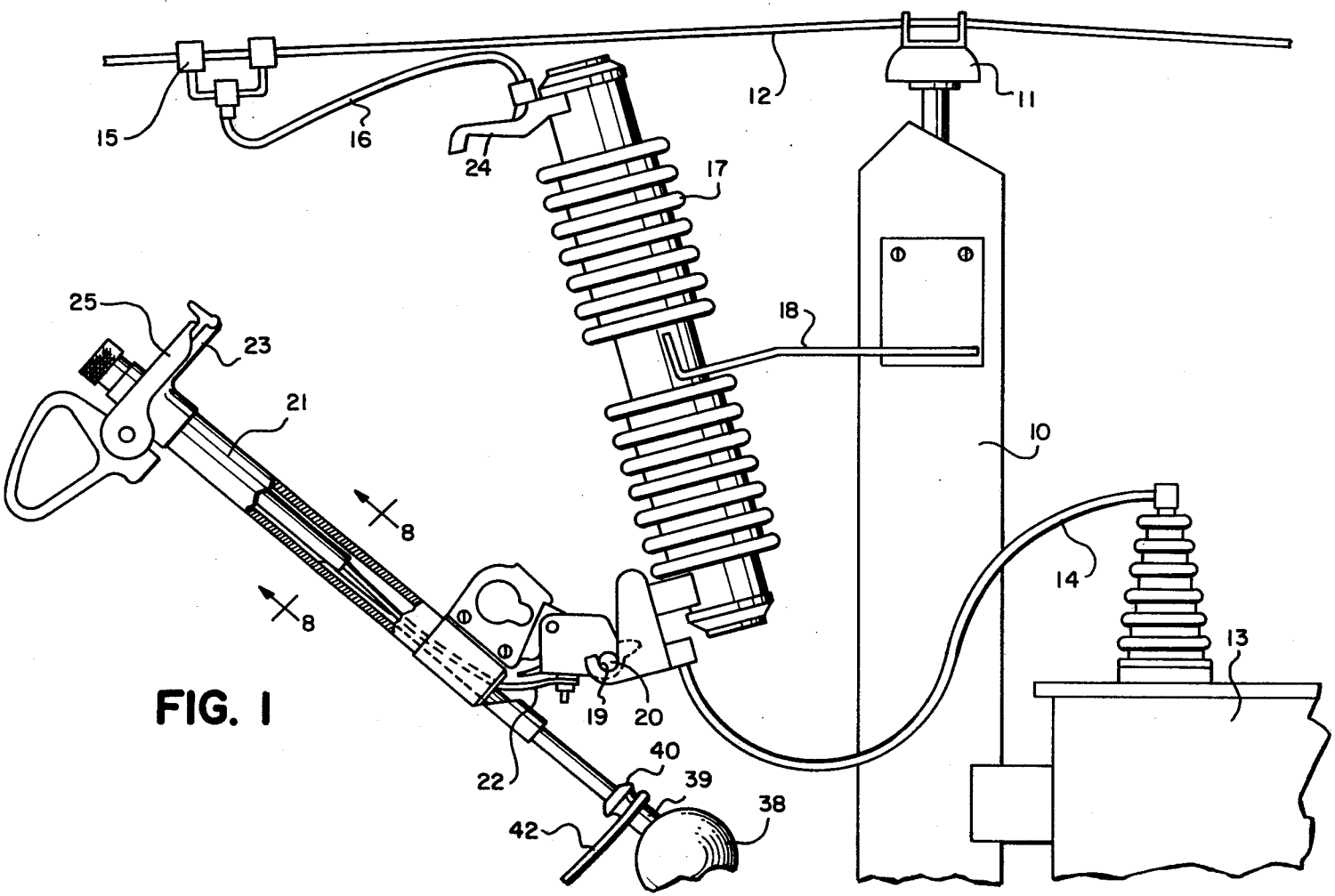
FIG. 1 is a view in elevation of the apparatus of the invention and showing the mounting of the fuse tube with the fuse tube partially raised.
Figure 2:
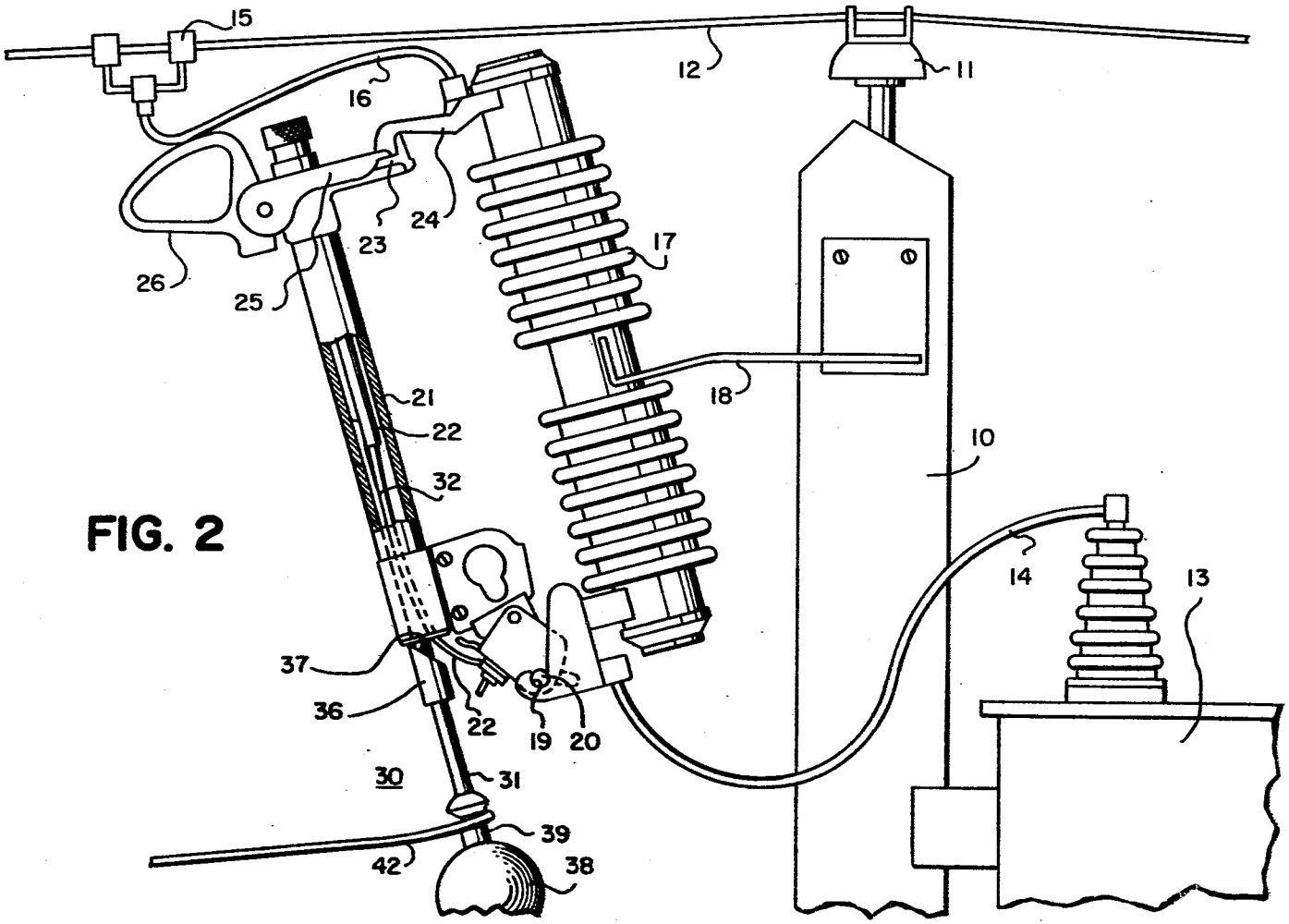
FIG. 2 is a view similar to FIG. 1 but with the fuse tube in latched and connected position.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings in which a preferred embodiment of the invention is illustrated a pole 10 is shown having an insulator 11 carried thereon for an overhead power line 12. The pole 10 is also shown as carrying electrical apparatus such as a high voltage transformer 13 for energization by the power line 12 through a conductor 14.

The power line 12 has thereon a hot line clamp 15 connected by a conductor 16 to an elongated insulated supporting body 17 which can also, if desired, by supported by a bracket 18 carried on the pole 10, or in any other desired manner.

The insulated supporting body 17 has, at the lower end thereof, spaced hooks 19 for the reception of pivot pins 20.

The pivot pins 20 are carried contiguous to one end of a conductive tubular switch member 21 pivotally carried on the hooks 19, which preferably is a fuse tube, and which has mounted therein a detachable fuse link 22 which will be melted in the event of an overload. The conductive switch member 21 has at the end opposite the pivot pins 20, an outwardly extending contact bar 23 for engagement with a contact bar 24 carried on the supporting body 17, and with which it is retained in engagement by a pivotally mounted latch 25 carried on the tubular switch member. The latch 25 is releasable, if desired, by movement of a handle 26 with a hot line tool or stick (not shown).

Figure 3:
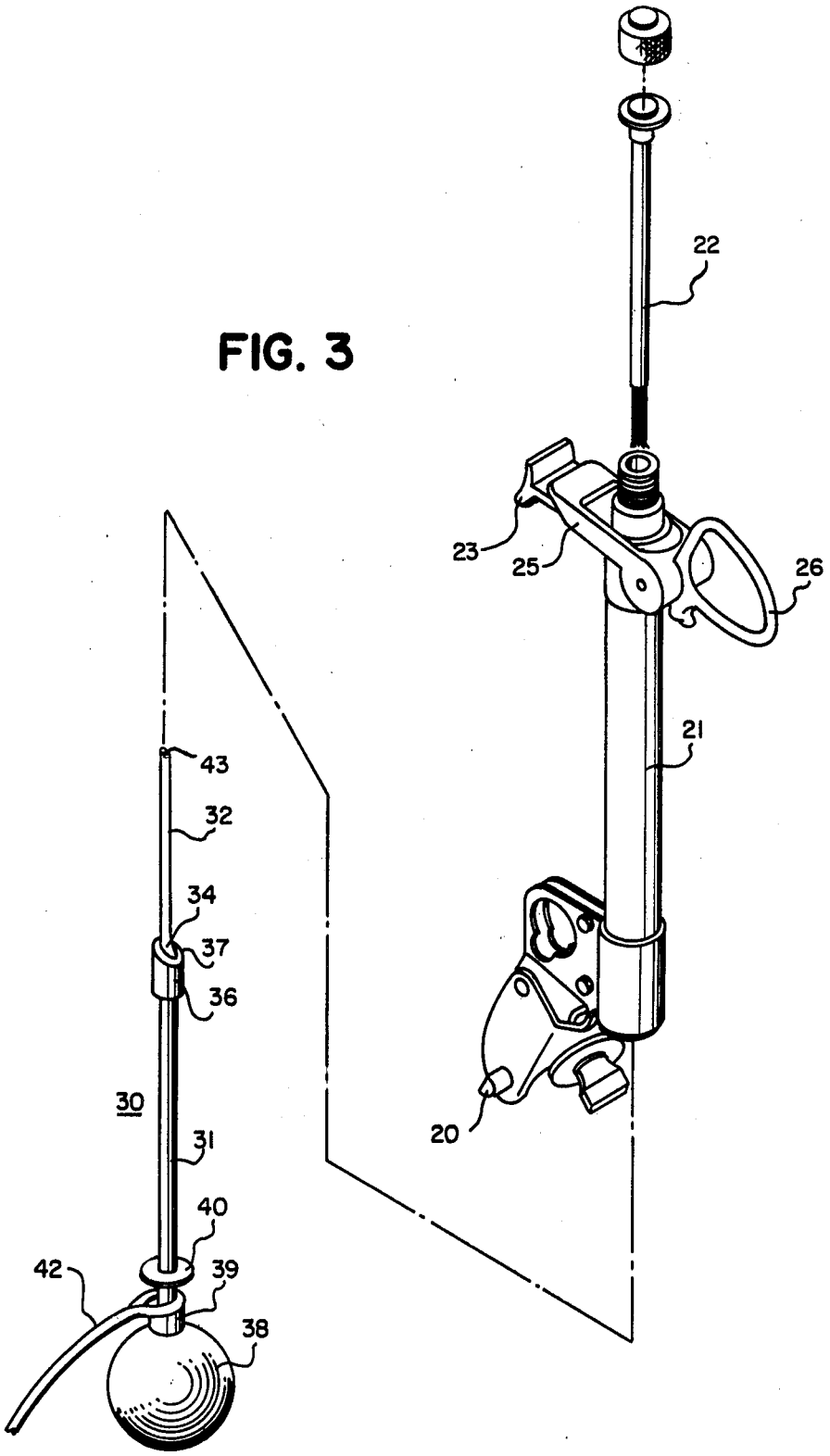
FIG. 3 is an exploded view of the fuse tube and the actuator therefor.
Figure 4:
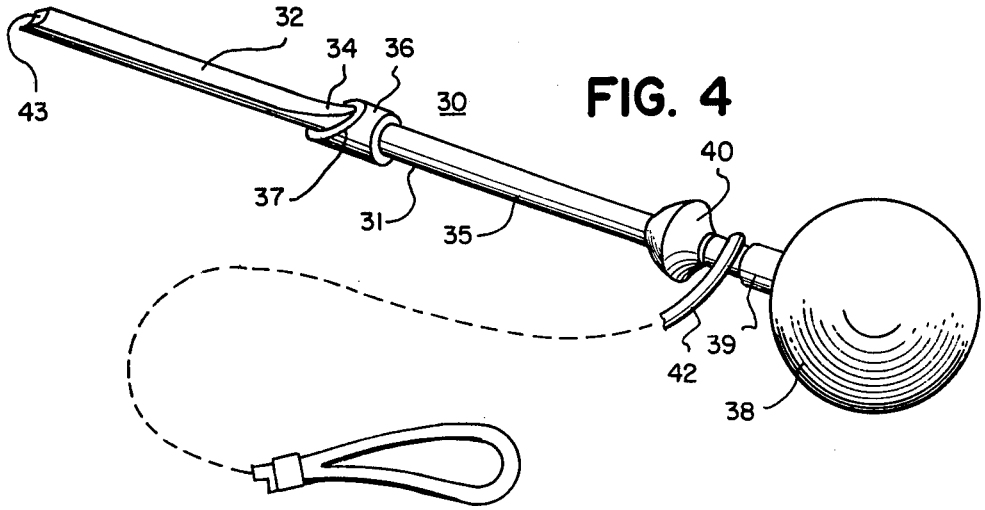
FIG. 4 is a perspective view of the apparatus.
Figure 5:
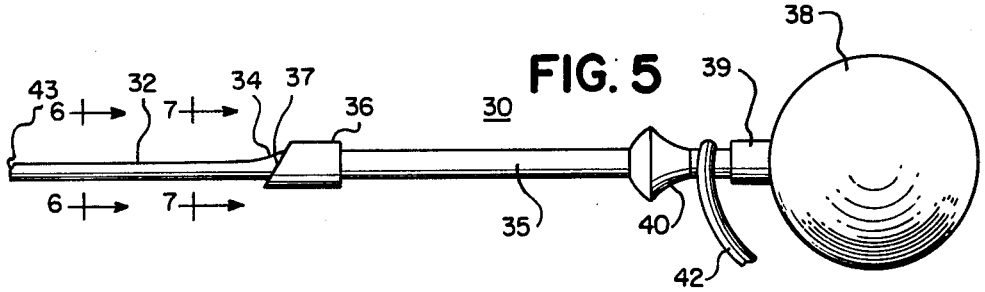
FIG. 5 is a side elevational view of the apparatus.
Figure 6:
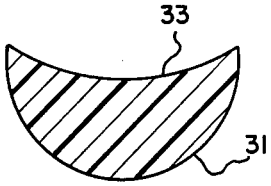
FIG. 6 is a vertical sectional view, enlarged, taken approximately on the line 6—6 of FIG. 5.
Figure 8:
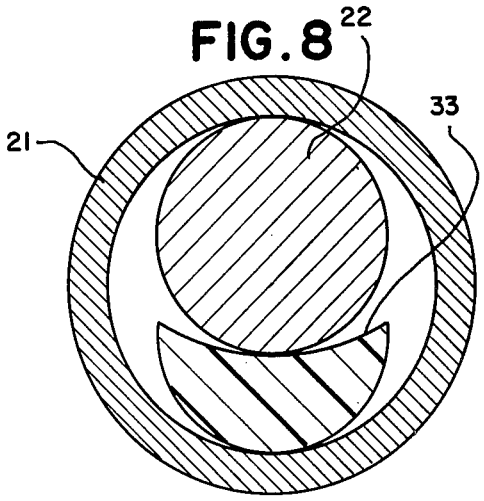
FIG. 8 is a transverse sectional view taken approximately on the line 8—8 of FIG. 1.
Figure 7:
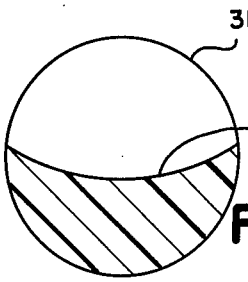
FIG. 7 is a vertical sectional view, enlarged, taken approximately on the line 7—7 of FIG. 5.

The apparatus 30 for the tubular switch member or fuse tube 21 is shown in detail in FIGS. 3 to 7, inclusive.

The apparatus 30 preferably includes a rod 31, preferably of molded glass fibers, flattened at one end as at 32 with a longitudinally extending arcuate face 33 for reception in the tubular interior of the switch member 21 which contains the fuse link 22. The size of the flattened end 32 may be varied as desired to accommodate it to the interior of the switch member 21. The face 33 has an inner beveled end 34. The rod 31 is preferably circular in cross section for the remainder of its length as at 35. The rod 31, intermediate its ends, has a stopper ring 36, one end of which, at 37, is beveled for purposes to be explained.

The rod 31 is secured to a ball 38, preferably of rubber, which has a collar 39 extending therefrom to serve as a stop. In spaced relation to the collar 39 a stop ring 40, preferably of rubber, is provided on the rod 31, to provide a location on the rod 31 for attachment of a cord 42 of nylon or polyethylene, having a diameter of one quarter of an inch, and which may be of a length of approximately fifty feet.

The outer end 43 of the rod 31 is preferably beveled to facilitate insertion in the fuse tube 21.

In one specific embodiment the rod 31 will be of an overall length of about fourteen inches, with a diameter of three eighths of an inch. The portion 32 will have a length of about five inches. The flattening of the portion 32 of the rod 31, varied to suit the interior space available in the fuse tube 21, may require the removal of one sixteenth to one eighth of an inch for the flattening. The ball 38, preferably of rubber, can have a diameter of two and one half inches.

In use, the fuse tube 21, has the rod 31 inserted therein along the fuse link 22, the insertion being facilitated by the beveled end 43, to the extent permitted by the stopper ring 36.

The hot line clamp 15 is attached to the overhead power line 12 and the clamp 15 and its conductor 16 are attached to the supporting body 17. The pivot pins 20 of the switch member or fuse tube 21, with the fuse link 22 therein, are inserted in the hooks 19, the conductor 14 is connected to the transformer 13 and the cord 42 is dropped to the ground.

With the lineman on the ground the cord 42 is pulled to swing the switch member 21 upwardly to engage the contact bars 23 and 24 for retention by the latch 25.

If there is a primary fault the fuse link 22 will explode, generate gas and the apparatus 30 will be ejected by the pressure on the end 43 of the rod 31. The beveled end 37 of the stopper ring 36 will permit the escape of gas generated by the explosion so that no damage to the apparatus 30 or to the switch member 21 will result.

Upon cure of the primary fault, the portion 32 of rod 31 can be inserted and operated as previously explained. If there is no primary fault and the fuse link does not explode, upon releasing of tension by the lineman on cord 42, the rod 31 will slide out of the fuse tube 21 and fall to the ground. The portion 32 of the rod 31 can be inserted in another fuse tube 21 and the apparatus operated as previously described.

I claim:

1. Apparatus for the remote closing of a pivotally mounted fuse carrying switch member which member includes a fuse tube carried by an insulating support and latching members for retaining such switch member in operating position which apparatus comprises a rod, said rod having a portion for insertion in said fuse tube and a portion extending beyond said fuse tube with a cushioned head thereon, and an actuating cord connected to said second mentioned rod portion contiguous to said head for moving said apparatus and said switch member for switch member engagement by said latching members.

2. Apparatus as defined in claim 1 in which said rod portion for insertion is of reduced cross section for insertion in said fuse tube.

3. Apparatus as defined in claim 1 in which said rod has a stopper ring on said second mentioned portion thereon for limiting the insertion of said first mentioned portion in said fuse tube.

4. Apparatus as defined in claim 1 in which said rod portion is ejected from said fuse tube upon failure of the fuse.

5. Apparatus as defined in claim 1 in which said rod portion will slide out of said fuse tube when tension is released from said actuating cord and said apparatus will fall to the ground.

6. Apparatus as defined in claim 1 in which said cushioned head is a rubber ball.

7. Apparatus as defined in claim 3 in which said stopper ring has a beveled end for permitting escape of gas from the interior of said fuse tube.

8. Apparatus as defined in claim 1 in which said rod is of molded glass fibers.

* * * * *